US009355577B1

(12) United States Patent
Coleman et al.

(10) Patent No.: US 9,355,577 B1
(45) Date of Patent: May 31, 2016

(54) UNITARY FLEXIBLE TAG ARTICLE

(71) Applicant: ALLIANCE RUBBER COMPANY, Hot Springs, AR (US)

(72) Inventors: Ginger Coleman, Lonsdale, AR (US); Peter Ferguson, Bismarck, AR (US); Bridget Harvey, Pearcy, AR (US); Michael Hughes, Arkadelphia, AR (US); Rusty Smoke, Malvern, AR (US); Richard R. Spencer, Hot Springs, AR (US)

(73) Assignee: ALLIANCE RUBBER COMPANY, Hot Springs, AK (US)

( * ) Notice: Subject to any disclaimer, the term of this patent is extended or adjusted under 35 U.S.C. 154(b) by 0 days.

(21) Appl. No.: 14/701,685

(22) Filed: May 1, 2015

(51) Int. Cl.
*G09F 3/02* (2006.01)
*G09F 3/04* (2006.01)

(52) U.S. Cl.
CPC ... *G09F 3/02* (2013.01); *G09F 3/04* (2013.01)

(58) Field of Classification Search
CPC ..... G09F 3/02; G09F 2003/0267; G09F 3/04
See application file for complete search history.

(56) References Cited

U.S. PATENT DOCUMENTS

| | | | | |
|---|---|---|---|---|
| 819,504 | A | 5/1906 | Benedict | |
| 1,005,894 | A | 10/1911 | Senseman | |
| 1,345,713 | A | 7/1920 | Stevens | |
| 1,854,149 | A * | 4/1932 | Laencher | 40/662 |
| 2,248,145 | A | 7/1941 | Wilder | |
| 2,609,629 | A | 9/1952 | Hubbard | |
| 2,669,047 | A | 2/1954 | Rieger | |
| 2,717,572 | A | 9/1955 | Kingman | |
| 2,781,550 | A | 2/1957 | Spencer | |
| 3,348,272 | A | 10/1967 | Germani | |
| 3,381,654 | A | 5/1968 | Hupp | |
| 3,572,396 | A | 3/1971 | Hoffman | |
| 3,757,936 | A * | 9/1973 | Lindegren | 206/527 |
| 3,787,552 | A | 1/1974 | Spencer | |
| 4,020,575 | A | 5/1977 | Kruger et al. | |
| 4,026,413 | A | 5/1977 | Britt | |
| 4,292,714 | A | 10/1981 | Walker | |
| 4,729,305 | A | 3/1988 | Spencer | |
| 4,779,367 | A * | 10/1988 | Fast | 40/657 |
| 4,914,789 | A | 4/1990 | Pedersen | |
| 5,113,757 | A | 5/1992 | Spencer | |
| 5,165,336 | A | 11/1992 | Spencer | |
| 5,231,735 | A | 8/1993 | Paxton | |
| 5,617,656 | A | 4/1997 | Ludlow et al. | |
| 5,913,619 | A | 6/1999 | Lowe | |
| D412,535 | S | 8/1999 | Tinklenberg et al. | |
| 6,024,225 | A | 2/2000 | Van der Donk | |
| 6,401,304 | B1 | 6/2002 | Dossett | |
| 6,684,464 | B1 | 2/2004 | Mody et al. | |

(Continued)

FOREIGN PATENT DOCUMENTS

WO 2004015495 A1 2/2004

*Primary Examiner* — Gary Hoge
(74) *Attorney, Agent, or Firm* — Renner, Kenner, Greive, Bobak, Taylor & Weber

(57) ABSTRACT

A unitary tag article is provided that may be characterized as a one-piece elastic sheet. The one-piece tag includes a fastener portion and a label portion that are formed from the same elastic sheet. The fastener portion is adapted to fasten onto an item, and the label portion is adapted to identify the item or provide information about the item. In one or more embodiments, the one-piece tag may serve a dual purpose of bundling items and identifying or providing information about said items.

2 Claims, 4 Drawing Sheets

(56) References Cited

U.S. PATENT DOCUMENTS

| | | | | |
|---|---|---|---|---|
| 6,704,971 | B2 | 3/2004 | Dossett et al. | |
| 6,810,811 | B2 | 11/2004 | Grounds | |
| 6,915,601 | B2 | 7/2005 | Davis et al. | |
| 6,915,602 | B2 | 7/2005 | Davis et al. | |
| 7,028,376 | B2 | 4/2006 | Mattesky | |
| 7,281,345 | B2 | 10/2007 | Ludlow et al. | |
| 7,640,687 | B2 | 1/2010 | Ludlow et al. | |
| 7,763,135 | B1 | 7/2010 | Maltas et al. | |
| 7,779,570 | B2 | 8/2010 | Riley | |
| 7,784,210 | B2 | 8/2010 | Riley et al. | |
| 7,823,310 | B2 | 11/2010 | Jain et al. | |
| 7,836,622 | B1 | 11/2010 | King et al. | |
| 7,877,915 | B2 | 2/2011 | Jain et al. | |
| 7,883,018 | B2 | 2/2011 | Riley et al. | |
| 7,918,045 | B2 | 4/2011 | Riley | |
| 7,926,215 | B2 | 4/2011 | Riker et al. | |
| 7,941,953 | B2 | 5/2011 | Ludlow et al. | |
| 8,006,422 | B2 | 8/2011 | Riley | |
| 8,011,125 | B2 | 9/2011 | Riley et al. | |
| 8,011,127 | B2 | 9/2011 | Ludlow et al. | |
| 8,074,389 | B2 | 12/2011 | Greer et al. | |
| 8,099,888 | B2 | 1/2012 | Riley | |
| 8,109,021 | B2 | 2/2012 | Jain et al. | |
| 8,316,566 | B2 | 11/2012 | Ludlow et al. | |
| 8,438,766 | B2 | 5/2013 | Ludlow et al. | |
| 8,590,195 | B2 | 11/2013 | Maltas et al. | |
| 8,631,599 | B2 | 1/2014 | Ludlow et al. | |
| 8,635,795 | B2 | 1/2014 | Ludlow et al. | |
| D712,154 | S | 9/2014 | Schiller et al. | |
| 8,819,972 | B2 | 9/2014 | Maltas | |
| 8,844,972 | B2 | 9/2014 | Riley et al. | |
| 8,904,686 | B2 | 12/2014 | Greer | |
| 2005/0022438 | A1* | 2/2005 | Bradley | 40/673 |
| 2005/0166439 | A1* | 8/2005 | Ludlow et al. | 40/665 |
| 2009/0188144 | A1* | 7/2009 | Ludlow et al. | 40/665 |
| 2010/0006587 | A1* | 1/2010 | Newmark | 221/70 |
| 2010/0139133 | A1* | 6/2010 | Adams | 40/299.01 |
| 2011/0306266 | A1 | 12/2011 | Glass | |
| 2012/0079687 | A1 | 4/2012 | Ingram | |
| 2013/0180138 | A1* | 7/2013 | Luea | 40/306 |
| 2013/0239449 | A1* | 9/2013 | Heinrichs | 40/665 |

* cited by examiner

UNITARY FLEXIBLE TAG ARTICLE

TECHNICAL FIELD

The present invention relates to a unitary flexible tag article. The present invention further relates to an elastic tag article including a label in unitary communication with an elastic fastener.

BACKGROUND OF THE INVENTION

Various products and methods are known and used for labeling merchandise involving the use of elastic bands such as rubber bands. Some devices mechanically connect a fastener to a label. For example, certain devices rely upon a two-step approach. In a first step, a rubber band is secured around an item of merchandise, or around a bundle of items, and then in a second step, a tag is mechanically attached to the rubber band. One example of this approach is described in U.S. Pat. No. 5,617,656 for a slotted orifice locking tag.

Other labeling devices are prepared by adhesively or thermally bonding a tag to an elastic band. One example of this approach is described in U.S. Pat. No. 8,631,599. It has been recognized that two-part labels may become detached under conditions of force or stress.

Therefore, a need exists in the art for an improved elastic tag article that includes a unitary label tag and fastener.

SUMMARY OF THE INVENTION

It is thus an object of one aspect of the present invention to provide a unitary flexible tag article. In one or more embodiments, the invention provides a unitary flexible tag article comprising a label having a first surface, a second surface, and an edge, said second surface opposing said first surface, said edge extending between said first and second surfaces, and a fastener in unitary communication with and extending away from said label, said fastener including an aperture and a band that completely surrounds said aperture.

Embodiments of the present invention provide a sheet of tag articles comprising a plurality of tag articles, each tag article comprising a label being in unitary communication with a fastener, said unitary connection occurring at a connection zone, each tag article having an outer boundary, at least a portion of each said outer boundary of each tag article being shared with another tag article.

BRIEF DESCRIPTION OF THE DRAWINGS

Advantages of the present invention will become better understood with regard to the following description and accompanying drawings wherein.

DETAILED DESCRIPTION OF ILLUSTRATED EMBODIMENTS

Figure 1:
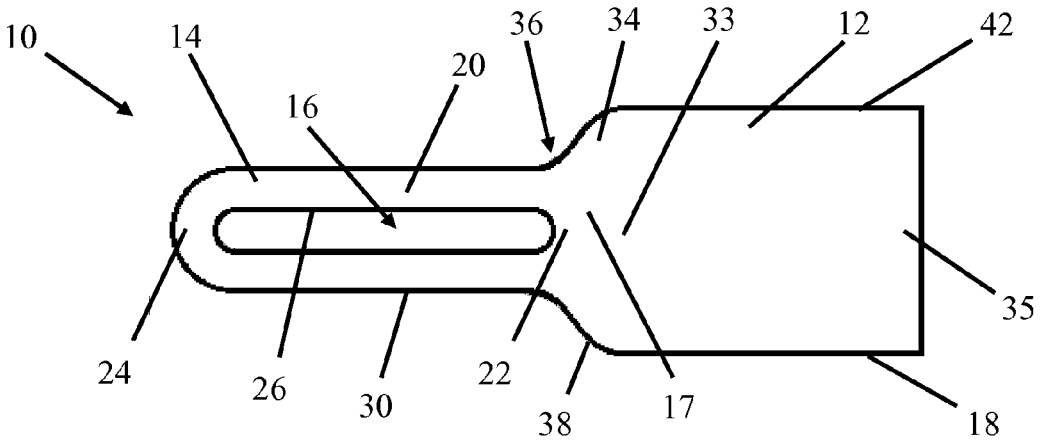
FIG. 1 is a front elevational view of an elastic tag article according to the concepts of the present invention, showing an embodiment having rounded shoulders, the rear elevational view being a mirror image thereof.

In one or more embodiments, a unitary tag article is provided that may be characterized as a one-piece elastic sheet. The one-piece tag includes a fastener portion and a label portion that are formed from the same elastic sheet. The fastener portion is adapted to fasten onto an item, and the label portion is adapted to identify the item or provide information about the item. In one or more embodiments, the one-piece tag may serve a dual purpose of bundling items and identifying or providing information about said items.

A tag article is generally indicated by the numeral 10 and includes a label 12 in unitary communication with a fastener 14. Tag article 10 may be defined by outer boundary 18. In one or more embodiments, tag article 10 includes label 12, which flatly, unitarily communicates along a connection zone 17 with fastener 14, and fastener 14 extends away from connection zone 17.

As used herein, unitary communication is intended at least to mean that tag article 10 is formed of a common material. As used herein, unitary communication is intended at least to mean that tag article 10 is not formed by connecting label 12 to fastener 14 through the use of an adhesive or bond zone. Based on the unitary communication, an additional assembly step is not required to communicate fastener 14 with label 12.

Tag article 10 may comprise elastic material, and therefore, in one or more embodiments, tag article 10 may also be described as elastic tag article 10. In these or other embodiments, fastener 14 may also be described as elastic fastener 14 or more generally as a fastener band.

Figure 4:
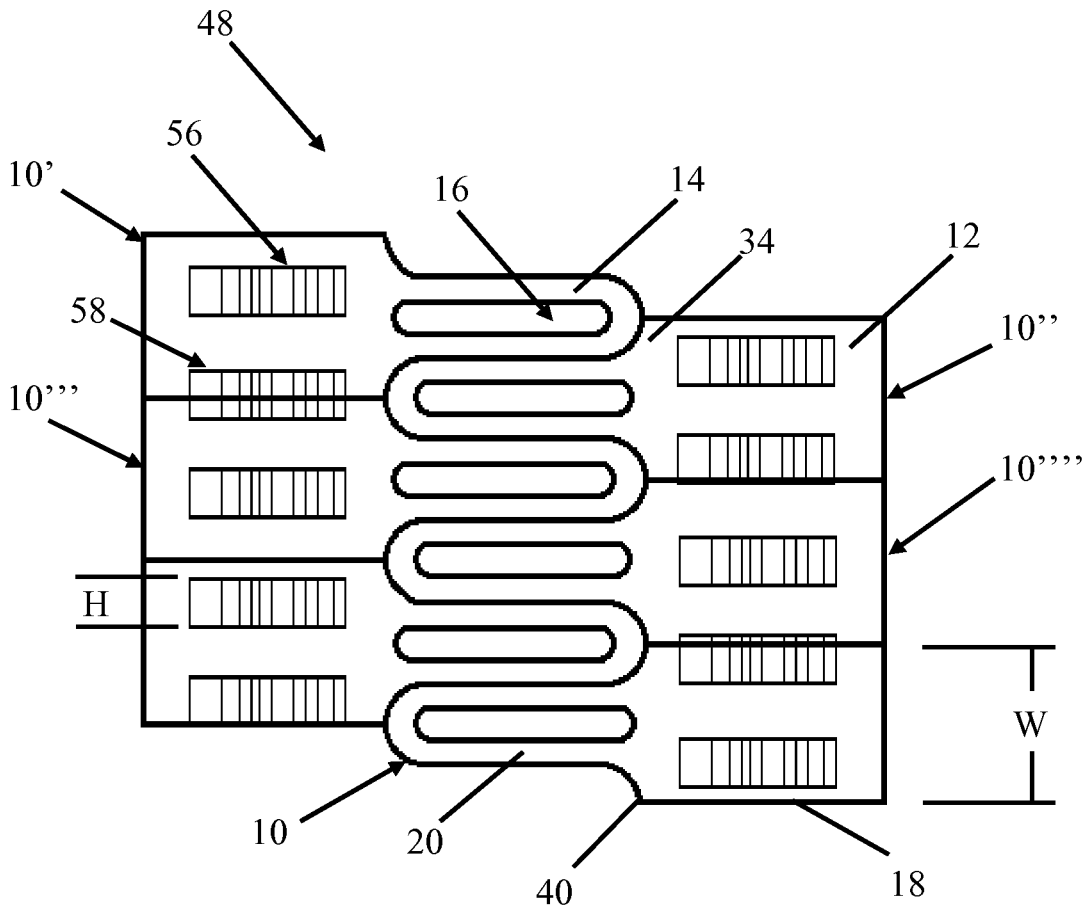
FIG. 4 is a front elevational view of an elastic tag article according to the concepts of the present invention, showing an embodiment having shoulder boundaries containing a point, and showing optional breakable connections, the rear elevational view being a mirror image thereof.

Referring to FIG. 1, tag article 10 can include label 12, fastener 14, aperture 16, connection zone 17, outer boundary 18, fastener sides 20, proximate fastener end 22, distal fastener end 24, aperture circumference 26, fastener outer boundary 30, proximate label end 33, shoulders 34, distal label end 35, curved neck indentations 36, curved boundary 38, and label outer boundary 42. Referring to FIG. 4, tag article 10 can include a shoulder boundary containing a point 40.

The entire article 10 is sheet-like in the sense that it is of a flat nature, although it may be drapeable and floppy and thus not always displayed in flat form. Label 12 and fastener 14 are in flat, unitary communication. It may be said that the sheet character of each extends unitarily into the sheet character of the other, giving a total unitary sheet-like character to article 10.

In one or more embodiments, fastener 14 is characterized by a loop-like shape that has flat sides 20 that define fastener band 14 along with a proximate fastener end 22 and a distal fastener end 24. Distal end 24 of fastener 14 is the end furthest from connection zone 17, and proximate end 22 of fastener 14 is closest to connection zone 17. In one or more embodiments, distal end 24 is rounded.

Fastener 14 includes aperture 16, having a circumference 26 that defines opening 16 within fastener 14. The proximate end 22 of fastener 14 may be said to unitarily merge into connection zone 17. Fastener 14 is also defined by an outer boundary 30. Both aperture circumference 26 and outer boundary 30 are substantially in the flat plane of fastener 14, and thus the sides 20 of fastener 14 are also substantially flat.

In one or more embodiments, aperture 16 may be an oval shaped slit. In other embodiments, aperture 16 may be of any shape. However, it has been found that a rounded opening is advantageously able to withstand more torsional force before tearing, when compared to a pointed opening. Similarly, it has been found that a rounded opening is advantageously able to withstand more torsional force before tearing, when compared to an opening having sharp corners. Thus, in one or more embodiments, aperture 16 does not include any pointed corners.

It is intended that one or more objects may be placed in opening 16 in order to be surrounded and/or secured by the fastener 14. Fastener 14 may be made to surround and secure one or more objects by manual intervention or machine intervention. Article 10 may hang from an object, such as a bottle neck, once fastener 14 is placed around said object.

Alternatively, the fastening process, i.e. the process of affixing or securing the tag article around an object, may take advantage of the elastic nature of fastener 14. In one or more embodiments, elastic fastener 14 may be stretched as to enlarge aperture 16 to be wider than the one or more objects to be secured in order to secure the objects, such as stretching fastener 14 around an assemblage of produce. Once the tag article is in place and the stretching force is discontinued, the elasticity of fastener 14 causes it to seek to return to its original shape and the fastener thus fits tightly around the object or objects. In one or more embodiments, the fastening process may utilize machinery, as further described in U.S. Pat. No. 6,024,225, which is incorporated herein by reference.

Where fastener 14 is placed around one or more objects, label 12 may provide identifying information. Notably, although label 12 is made from elastic material, when fastener 14 is securing one or more objects, label 12 is not in a stretched or stressed position. Thus, if identifying information is present on label 12, it is not distorted when fastener 14 is placed around one or more objects and may therefore be read easily by a user or a machine.

As said above, label 12 is in unitary communication with fastener 14. This communication may be described as connection zone 17. When fastener 14 is positioned as to secure one or more objects therein, connection zone 17 will receive at least some of the applied stress that occurs when fastener 14 is elastically opened.

Connection zone 17 is located between a proximate end 33 of label 12 and a proximate end 22 of fastener 14. The distal end 35 of label 12 and the distal end 24 of fastener 14 are the ends furthest from connection zone 17. It may be said that proximate end 33 and distal end 35 of label 12 are in communication by way of the body of label 12 and that proximate end 22 and distal end 24 of fastener 14 are in communication by way of the sides 20 of fastener 14.

Connection zone 17 may be said to include two lateral shoulders 34 that are formed by curved neck indentations, generally indicated by the numeral 36. The curve of the curved neck indentations 36 helps in allowing connection zone 17 to receive the applied stress without tearing. Sharp corners in the material may increase the propensity of the material to tear.

Each lateral shoulder 34 may be said to merge into label 12. As represented in the figures, shoulders 34 may have either an entirely curved boundary 38, as shown in FIG. 1, or shoulders 34 may have a boundary containing a point 40, as shown in FIG. 4. As will be discussed later, the shape of the shoulder boundary may advantageously be selected based upon the desired alignment of a plurality of tag articles 10 into a sheet, and so that waste may be reduced during the production process.

The shape of label 12 is not particularly limited. That is, label 12 may have any suitable shape, and may be primarily decorative in some embodiments, or the shape may have a particular informational value in other embodiments. Examples of suitable shapes for label 12 include circles, ovals, hearts, crosses, letters, numbers, and others too numerous to mention.

In one or more embodiments, label 12 may include cut-out portions, for either decorative or informational purposes.

In one or more embodiments, label 12 is a flexible sheet. Label 12 includes a first surface that may be described as a front surface, and a second surface that may be described as a rear surface. The second surface opposes the first surface and is connected to the first surface by an edge extending between the first and second surfaces.

In one or more embodiments, label 12 comprises three straight sides that are at approximately right angles to each other. In these or other embodiments, label 12 comprises a generally rectangular or square shape.

In one or more embodiments, label 12 may further include an informative and/or decorative layer such as an arrangement of text or designs on one or more surfaces of label 12. In one or more embodiments, the informative and/or decorative layer is printed or stamped onto a surface of label 12. In one or more embodiments, the informative and/or decorative layer is adhered to a surface of label 12. In one or more embodiments, the informative and/or decorative layer is on the front surface of label 12.

In one or more embodiments, article 10 may further include at least one coating. The nature and purpose of the coating is not limited. In one or more embodiments, the coating is a receptive coating that prepares the surface of article 10 for being printed on, such as by ink jet printing. In one or more embodiments, a receptive coating is selected from the group consisting of acrylics, polyurethanes, and polyvinyl chloride. In one or more embodiments, a receptive coating is receptive to an ink system selected from the group consisting of ink jet, solvent, aqueous, eco-solvent, and ultraviolet cure. Other suitable receptive coatings and methods of printing on receptive coating are generally known to those skilled in the art. In one or more embodiments, the coating is an overcoat that protects the informative and/or decorative layer.

As described above, fastener 14 and label 12 may have a variety of shapes. Thus, tag article 10 may have a variety of shapes. In one or more embodiments, the shapes of fastener 14, label 12, and tag article 10 are selected such that a plurality of tag articles may be proximately positionable with each other, such that they each share a portion of outer boundary 30 with at least one other tag article.

Thus, one or more embodiments of the present invention further provides a unitary elastic sheet that includes a plurality of the tag articles as described herein. Each tag article can be integrally joined along at least one edge to another tag article. The joined edge(s) may be perforated or otherwise be breakably connected to allow easy separation.

In one or more embodiments, at least four tag articles may be positionable in a sheet-like fashion, with some of the tags occupying positions at the edges of the sheet, and the other tags in inner positions. In one or more embodiments, at least four tag articles may be positionable in a sheet-like fashion, with two of the tags on opposing ends, and the other tags in inner positions. In these or other embodiments, the inner tags may share a portion of outer boundary 18 with two other tag articles. The plurality of tags may be breakably connected, such as by perforations.

Figure 3:
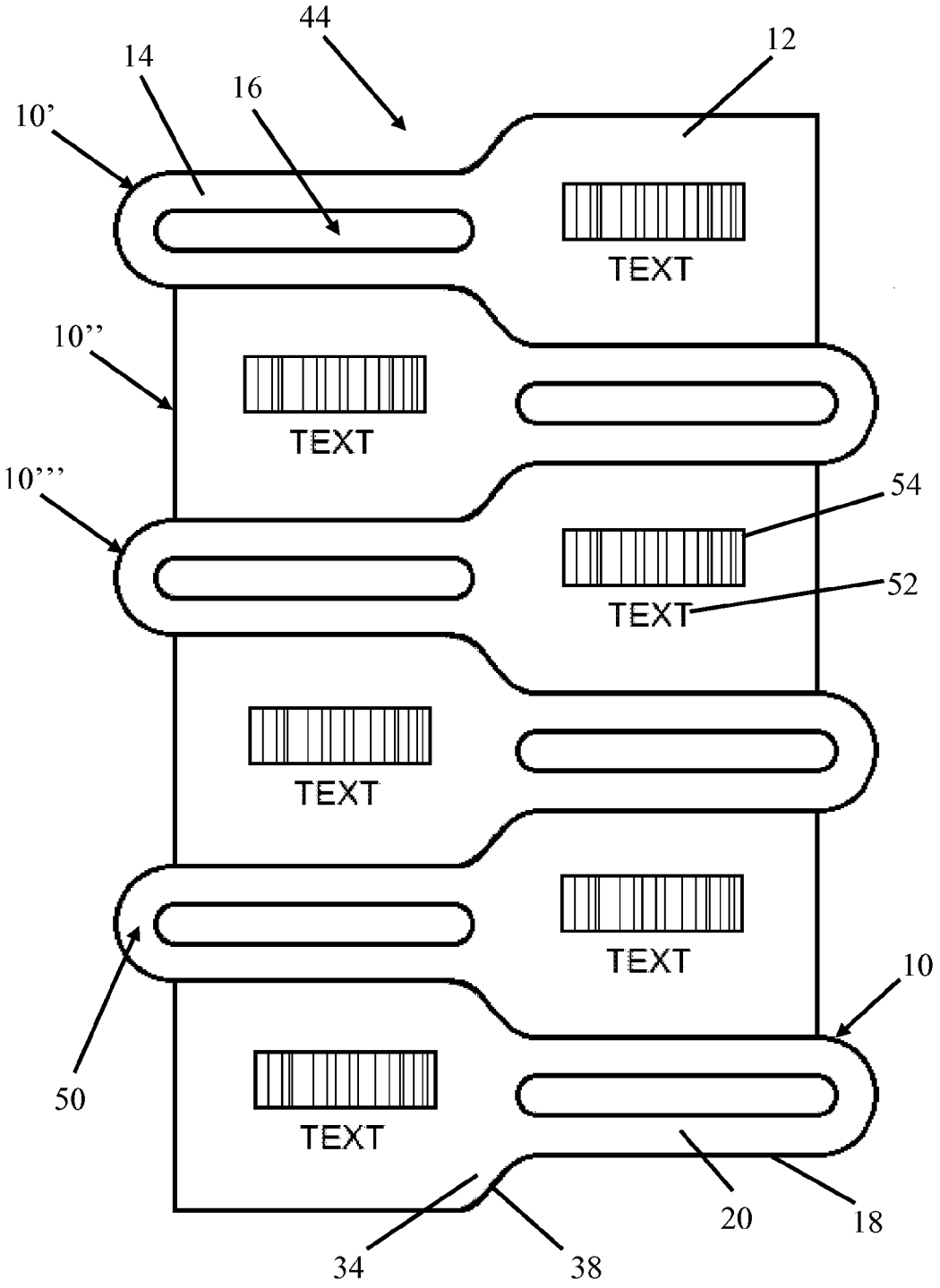
FIG. 3 is a front elevational view of a plurality of the elastic tag articles from FIG. 2 shown in sheet form.

Outer boundary 18 includes and is continuous with outer boundary 30 of fastener 14, outer boundary 42 of label 12, and shoulder boundary 38 or 40. Any portion of outer boundary 18 may be shared with one or more tag articles. That is, in one or more embodiments, the orientation of each tag article may be alternated, so that a first tag article shares outer label boundary 42 with a second tag article's outer fastener boundary 30. This arrangement is generally shown in FIG. 3. In other embodiments, not shown in the figures, all tag articles could be in the same orientation, so that the boundary that is shared is outer label boundary 42.

Figure 6:
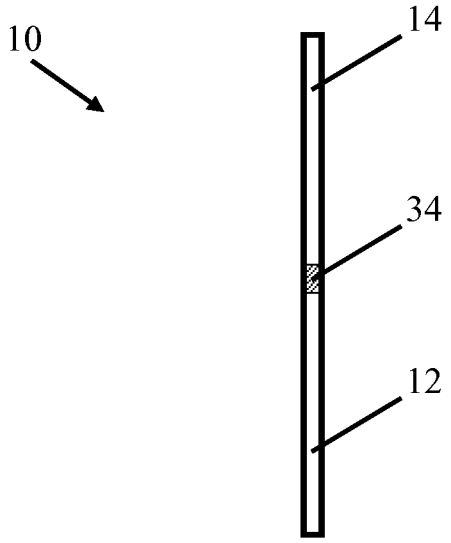
FIG. 6 is a front elevational view of a plurality of elastic tag articles having shoulder boundaries containing a point shown in sheet form.

In one or more embodiments, where curved shoulder boundaries 38 are utilized, a first article 10' may be adjacently positionable with a second article 10" as shown in FIG. 3. At least a portion of a side of outer boundary 30 of fastener 14 of first article 10' may be positioned adjacent to at least a portion of the side outer boundary 42 of label 12 of second article 10". Further, the shoulder boundary 38 of first article 10' may be positioned adjacent to shoulder boundary 38 of second article 10" and at least a portion of a side of the outer boundary 42 of label 12 of first article 10' may be positioned adjacent to at least a portion of a side of the outer boundary 30 of fastener 14 of second article 10". Then, a third article 10' may be positioned adjacent to second article 10" in the same manner as first article 10'. This pattern may be repeated countless times as to form a sheet, generally indicated by the numeral 44, containing a plurality of articles 10.

Where shoulder boundaries containing a point 40 are utilized, a first article 10' may be adjacently positionable with a second article 10" as shown in FIG. 6. A side of outer boundary 30 of fastener 14 of first article 10' may be positioned adjacent to a side of outer boundary 30 of fastener 14 of second article 10". Further, the shoulder boundary 40 of first article 10' may be positioned adjacent to a portion of distal end 24 of fastener 14 of second article 10". At least a portion of a side of the outer boundary 42 of label 12 of first article 10' may be positioned adjacent to at least a portion of a side of the outer boundary 42 of label 12 of third article 10". The second side of outer boundary 30 of fastener 14 of second article 10" may be positioned adjacent to a side of outer boundary 30 of fastener 14 of third article 10". Then, a fourth article 10"" may be positioned adjacent to second article 10" and third article 10'" in the same manner. This pattern may be repeated countless times as to form a sheet, generally indicated by the numeral 48, containing a plurality of articles 10.

As shown in FIG. 3, a portion of a first article 10', the portion generally indicated by the numeral 50, may extend beyond the end of an adjacent second article 10". This extension portion 50 may offer one or more advantages, such as serving as a pull tab for separating an article from a sheet.

In one or more embodiments, tag article 10 comprises a single uniform composition. That is, the fastener portion and label portion may be formed from a single sheet. In one or more embodiments, the composition of tag article 10 is a rubbery polymer that has elastic properties. Advantageously, the elastic properties enable fastener 14 to stretch around and secure one or more objects.

In one or more embodiments, elastic tag article 10 may be formed from a thermoset elastomer. In one or more embodiments, elastic tag article 10 may be made from a thermoplastic elastomer. In one or more embodiments, elastic tag article 10 may be made from a silicone polymer. In one or more embodiments, elastic tag article 10 comprises one or more rubbery polymers selected from the group consisting of polyisoprene, ethylene propylene diene terpolymer (EPDM), styrene-butadiene rubber (SBR), butadiene rubber (BR), thermoplastic elastomers (TPE), thermoplastic olefinic elastomer (TPO), thermoplastic polyurethanes (TPU), and thermoplastic vulcanizates (TPV).

Elastic tag article 10 may be characterized by the tensile strength or elongation percentage of the material used to manufacture elastic tag article 10. In one or more embodiments, elastic tag article 10 has a tensile strength in the range of from 700 psi or more to 5000 psi or less. In one or more embodiments, elastic tag article 10 has a tensile strength in the range of from 900 psi or more to 1300 psi or less. In one or more embodiments, elastic tag article 10 has a tensile strength in the range of from 2200 psi or more to 3000 psi or less. In one or more embodiments, elastic tag article 10 has a tensile strength in the range of from 4500 psi or more to 5000 psi or less. In one or more embodiments, elastic tag article 10 has a tensile strength of 1100 psi or approximate thereto. In one or more embodiments, elastic tag article 10 has a tensile strength of 2200 psi or approximate thereto. In one or more embodiments, elastic tag article 10 has a tensile strength of 3000 psi or approximate thereto. In one or more embodiments, elastic tag article 10 has a tensile strength of 4700 psi or approximate thereto.

In one or more embodiments, tag article 10 may be characterized by an ultimate elongation, which is sometimes referred to as elongation at point of failure or elongation at break, of at least about 100%, in other embodiments, at least about 300%, in other embodiments, at least about 1300%, in other embodiments, at least about 1400%. In one or more embodiments, tag article 10 may be characterized by an elongation at break in the range of from 100% or more to 1500% or less, in other embodiments, 200% or more to 500% or less, in other embodiments, 300% or more to 400% or less, and in other embodiments, 1300% or more to 1400% or less.

In one or more embodiments, tag article 10 may be characterized as being autoclavable. In one or more embodiments, tag article 10 may be characterized as being suitable for contact with food. In one or more embodiments, tag article 10 may be characterized as being suitable for use as an indirect food contact grade material under the U.S. Food and Drug Administration regulations and the related Code of Federal Regulations. The relevant FDA regulations and CFR portions are incorporated herein by reference.

In one or more embodiments, the tag article may further comprise a removable release layer. The removable release layer may comprise a paper, film, or foil substrate coated with a release agent. Typically, release agents are chemically based upon silicone thermosetting resins, fluorosilicone thermosetting resins, or octadecyl carbamate resins. In one embodiment, the removable release layer comprises silicone-treated release paper.

In a method of manufacturing tag article 10, rubbery polymer may be processed as known to one skilled in the art to produce a sheet. The sheet may be cut or otherwise shaped to produce individual tag articles, or to produce a plurality of tag articles that are removably connected by perforation. In one or more embodiments, outer boundary 18 and aperture 16 may be formed in a single cutting step. Alternatively, the aperture circumference 26 may be cut after outer boundary 18 is cut.

The cutting described herein may be done by any technique known in the art. Examples of devices for cutting include a rotary die cutter, a continuous roll cutter, a die stamp cutter, a laser, and a water jet.

In one or more embodiments, the tag articles may be completely separated from each other by a continuous cut that extends all the way through the sheet. In other embodiments, the sheet is perforated, leaving the tag articles breakably connected by perforations. The partially cut boundary lines will tear or break when suitable force is exerted thereon. The removably connected tag articles may collectively be referred to as a chain. The chain may be broken and the individual tag articles separated by hand or by use of a separating device or by any method known in the art.

When the sheet is perforated along boundary lines to form two or more adjacent articles, one or more breakable connections are formed between the adjacent articles. When the connection is broken and the articles are separated, one or more protrusions 46 may remain on the edge of the tag article, as shown in FIG. 4.

The optional coating and the informative/decorative layer (s) may be applied to a surface of article 10 before or after the step(s) of cutting and/or the step of separating the tag articles.

In one or more methods of manufacturing elastic tag article 10, tag article 10 can be formed by injection molding. In one or more methods of manufacturing elastic tag article 10, tag article 10 can be formed by additive manufacturing. Injection molding and additive manufacturing can be particularly useful for forming individual tag assemblies 10, rather than forming a sheet of tag assemblies 10. The relevant details of injection molding and additive manufacturing are generally known to those skilled in the art.

Figure 2:
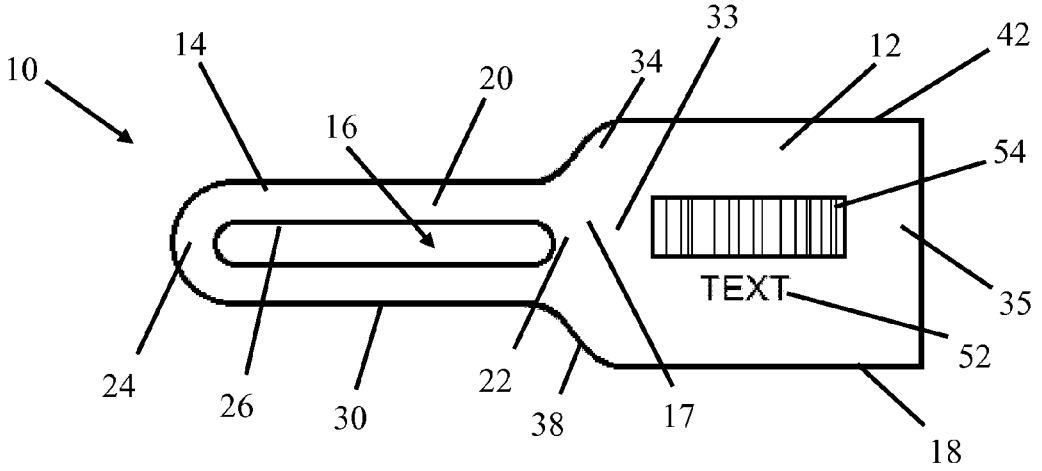
FIG. 2 is a front elevational view similar to FIG. 1 but showing a label on the elastic tag article.

In one or more embodiments, label 12 may include one or more colors, and the color may have significance for either identification or decoration. In one or more embodiments, label 12 includes one or more identifying or decorative indicia on one or more of its surfaces. As seen in FIGS. 2 and 3, such indicia may include text 52 and/or Universal Product Code (UPC) barcodes 54. Other representative labels include Quick Response Codes (QR Code), symbols, and images. For purposes of this specification, the term "indicia" should be interpreted broadly to include text, symbols, tokens, designs, codes, insignias and other types of distinguishing marks.

In one or more embodiments, label 12 includes at least one complete indicia, generally represented by indicia 56 in FIG. 6, having its entirety fully on the surface of label 12. It will be understood that label 12 may also include one or more incomplete indicia, as generally indicated by the numeral 58 in FIG. 6. Such incomplete indicia 58 may be tolerated so that non-precision printing may be used. The details of non-precision printing are known to those skilled in the art and non-precision printing is intended to mean that the printer is not aware of the position of article 10. An example of non-precision printing is the use of a rotary printer.

Where non-precision printing is utilized, as by the use of a rotary printer, the printing clearances may be designed to ensure that at least one full height H (FIG. 6) of label 56, 58 is included within the width W of label 12. One example of this design is by requiring that the dimension of W be two or more times the dimension of H. This ensures that at least one full height H will be printed within the width W of label 12. Such can be accomplished by adjusting print clearances.

In one or more embodiments, precision printing may be used to impart one or more labels on to label 12. Precision printing includes printing techniques that allow the printer to print an image in a predetermined location on an article. For example, alignment dots or notches may be used to align the article to be printed. Advantageously, aperture 16 may serve the additional function of aiding in the alignment of tag 10 for precision printing.

One or more aspects of printing an indicia onto a tag may be further described in U.S. Pat. Nos. 4,729,305 and 5,113,757, which are incorporated herein by reference.

Indicia may be printed, stamped, or applied to the label portion of the tag in a variety of methods. Materials that may be used to form the indicia include ink such as elastic inks, non-elastomeric inks, polymeric inks, and dye stain inks. The term "ink" should be broadly construed to include many different types of colorant, pigments, and dyes.

Advantageously, the tags may be arranged on a sheet in a configuration that reduces that amount of cut-away waste material during the manufacture of the tags. More specifically, because a plurality of articles may be adjacently positioned, the amount of cutaway waste may be reduced. Additionally the adjacent arrangement allows for non-precision printing while still ensuring that at least one complete indicia will be visible on the tag.

Advantageously, the size and thickness of tag article 10 is not particularly limited. It is envisioned that tag article 10 may be made in any suitable size and thickness. Particular sizes or thicknesses may be designed based on the intended use of article 10.

Tag article 10 may be characterized by its overall dimensions. In one or more embodiments, tag article 10 has a length in the range of from 2 inches or more to 4 inches or less. In one or more embodiments, tag article 10 has a length in the range of from 1 inch or more to 6 inches or less.

In one or more embodiments, tag article 10 has a width in the range of from 1 inch or more to 3 inches or less. In one or more embodiments, tag article 10 has a width in the range of from 0.5 inches or more to 5 inches or less.

Tag article 10 may be characterized by the ratio of its length to its width. In one or more embodiments, the ratio of the length to the width of tag article 10 is in the range of from 1:1 to 3:1. In one or more embodiments, the ratio of the length to the width of article 10 is in the range of from 1.5:1 to 2:1.

Tag article 10 may be characterized by the size of label 12. In one or more embodiments, label 12 has an area in the range of from 0.5 square inches or more to 10 square inches or less. In one or more embodiments, label 12 has an area in the range of from 1 square inch or more to 5 square inches or less. In one or more embodiments, label 12 has an area in the range of from 2 square inches or more to 3 square inches or less.

Tag article 10 may be characterized by the ratio of the area of label 12 to the area of fastener 14. In one or more embodiments, the ratio of the area of label 12 to the area of fastener 14 is in the range of from 1:3 to 5:1. In one or more embodiments, the ratio of the area of label 12 to the area of fastener 14 is in the range of from 1:1 to 3:1. In one or more embodiments, the ratio of the area of label 12 to the area of fastener 14 is in the range of from 2:1 to 3:1.

Figure 5:
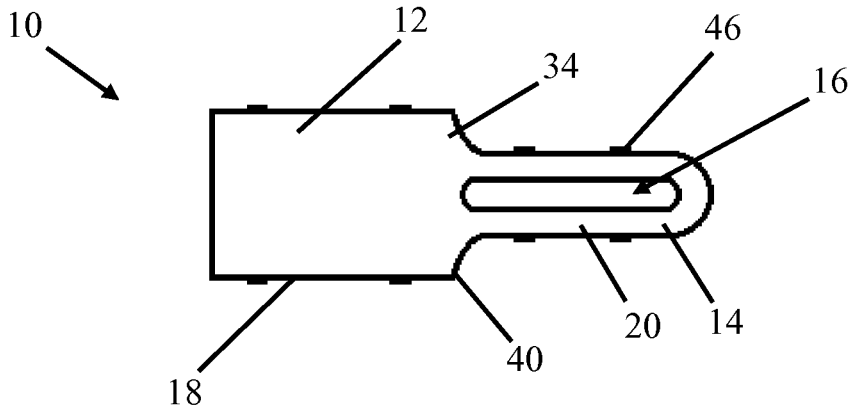
FIG. 5 is a side elevational view of an elastic tag article, the opposing side view being a mirror image thereof.

As shown in the side view in FIG. 5, tag article 10 has a certain thickness. The thickness of tag article 10 may be designed based on the desired application, particularly for the objects to be secured by fastener 14. If more strength is required, a larger thickness may be utilized. If greater elasticity is desired, a smaller thickness may be utilized. The thickness may also be selected based on a desired holding strength for fastener 14. In one or more embodiments, elastic tag article 10 has a thickness in the range of from 1/16 inches or more to 1/8 inches or less. In one or more embodiments, elastic tag article 10 has a thickness in the range of from 1/32 inches or more to 1/16 inches or less. In one or more embodiments, elastic tag article 10 has a thickness of 1/32 inches or less. In one or more embodiments, elastic tag article 10 has a thickness of 1/16 inches or less. In one or more embodiments, elastic tag article 10 has a thickness of 1/8 inches or less.

Advantageously, embodiments of the present invention provide an elastic tag article that does not require or include a bond zone between two different materials. Embodiments of the invention provide an elastic tag article having a shape that requires less waste material in the manufacturing process. In one or more embodiments, unitary elastic sheets are provided that contain a plurality of integrally joined tag articles.

Various modifications and alterations that do not depart from the scope and spirit of this invention will become apparent to those skilled in the art. This invention is not to be duly limited to the illustrative embodiments set forth herein.

We claim:

1. A sheet comprising a plurality of tag articles, each tag article having an outer boundary, at least a portion of each said outer boundary of each tag article being shared with another tag article, each tag article comprising a label being in unitary communication with a fastener, said unitary communication occurring at a connection zone, each of said connection zones defined by two shoulder boundaries, each fastener having an outer boundary, each label having an outer boundary, each of said tag article outer boundaries including and being continuous with a fastener outer boundary, a label outer boundary, and the two shoulder boundaries of the tag article, each shoulder boundary being a curved boundary, the sheet including a first article adjacently positionable with a second article, at least a portion of the fastener outer boundary of said first article being adjacently positioned to at least a portion of the label outer boundary of said second article, at least a portion of the fastener outer boundary of said second article being adjacently positioned to at least a portion of the label outer boundary of said first article, and a first shoulder boundary of said first article being adjacently positioned to a first shoulder boundary of said second article.

2. A sheet of tag articles comprising a plurality of tag articles, each tag article comprising a label being in unitary communication with a fastener, said unitary connection occurring at a connection zone, each tag article having an outer boundary, at least a portion of each said outer boundary of each tag article being shared with another tag article, each of said unitary connections being defined by two shoulder boundaries, each fastener having an outer boundary, each label having an outer boundary, each of said tag article outer boundaries including and being continuous with a fastener outer boundary, a label outer boundary, and the two shoulder boundaries of the tag article, each shoulder boundary comprising a point, the sheet including at least a first article adjacently positionable with a second article and a third article, said second article being adjacently positionable with said first article, said third article, and a fourth article, said third article being adjacently positionable with said first article, said second article, and said fourth article, at least a portion of the fastener outer boundary of said first article being adjacently positioned to at least a portion of the fastener outer boundary of said second article, at least a portion of the label outer boundary of said first article being adjacently positioned to at least a portion of the label outer boundary of said third article, at least a portion of the fastener outer boundary of said second article being adjacently positioned to at least a portion of the fastener outer boundary of said third article, at least a portion of the fastener outer boundary of said third article being adjacently positioned to at least a portion of the fastener outer boundary of said fourth article, at least a portion of the label outer boundary of said second article being adjacently positioned to at least a portion of the label outer boundary of said fourth article, a first shoulder boundary of said first article being adjacently positioned to a portion of said fastener outer boundary of said second article, a first shoulder boundary of said second article being adjacently positioned to a portion of said fastener outer boundary of said first article, a second shoulder boundary of said second article being adjacently positioned to a portion of said fastener outer boundary of said third article, a first shoulder boundary of said third article being adjacently positioned to a portion of said fastener outer boundary of said second article, a second shoulder boundary of said third article being adjacently positioned to a portion of said fastener outer boundary of said fourth article, and a first shoulder boundary of said fourth article being adjacently positioned to a portion of said fastener outer boundary of said third article.

* * * * *